US005909783A

United States Patent [19]

Berish

[11] Patent Number: 5,909,783

[45] Date of Patent: Jun. 8, 1999

[54] MOTORIZED SCAFFOLD HOISTING APPARATUS

[75] Inventor: Robert P. Berish, Sharon, Mass.

[73] Assignee: Quality Steel Products, Inc., Stoughton, Mass.

[21] Appl. No.: 08/864,276

[22] Filed: May 28, 1997

[51] Int. Cl.[6] ..... E04G 1/20

[52] U.S. Cl. ..... 182/146; 182/136; 182/141

[58] Field of Search ..... 182/133, 141, 182/142, 145, 146, 147, 148, 136

[56] References Cited

U.S. PATENT DOCUMENTS

| | | | |
|---|---|---|---|
| 2,273,572 | 2/1942 | Haider | 187/9 |
| 3,146,855 | 9/1964 | Aberegg . | |
| 3,323,616 | 6/1967 | Best | 182/146 |
| 4,223,507 | 9/1980 | Mascaro | 52/730 |
| 4,382,488 | 5/1983 | Anderson | 182/136 |
| 4,512,440 | 4/1985 | Bixby | 182/146 |
| 4,597,471 | 7/1986 | Anderson | 182/136 |
| 4,598,794 | 7/1986 | Anderson | 182/113 |
| 4,805,735 | 2/1989 | Anderson | 182/138 |
| 4,886,139 | 12/1989 | Dupont | 182/146 |
| 4,942,940 | 7/1990 | Boeshart | 182/146 |
| 5,042,615 | 8/1991 | Anderson | 182/136 |
| 5,259,478 | 11/1993 | Berish et al. | 182/136 |

FOREIGN PATENT DOCUMENTS

| | | | |
|---|---|---|---|
| 1399579 | 4/1965 | France . | |
| 2624173 | 6/1989 | France | 182/222 |
| 1434383 | 10/1968 | Germany . | |

*Primary Examiner*—Alvin Chin-Shue
*Attorney, Agent, or Firm*—Pandiscio & Pandiscio

[57] ABSTRACT

Novel motorized scaffold hoisting units are provided that are intended to be used in pairs with two jack poles. Each unit comprises a carriage that is adapted to be slidably disposed on a jack pole and has guide means that restrain the carriage from moving laterally while allowing it to be raised or lowered along the length of the pole. Each unit also comprises a hoist or winch that is mounted on a platform carried by the carriage and comprises a cable-carrying drum and a power transmission for rotating the drum in response to rotative power supplied by an auxiliary electrically powered driver. The outer end of the cable carried by the drum is adapted to be releasably attached to the upper end of a jack pole on which the unit is mounted. Each carriage also carries at least two fail-safe brake means for releasably gripping the pole on which the carriage is mounted, and means in the form of a laterally-projecting arm for supporting a scaffold, e.g., a wooden or aluminum plank. Each transmission is adapted to be driven by an electrically powered driver, e.g., a battery-powered electric drill fitted with a socket wrench that mates with the input shat of the power transmission.

26 Claims, 5 Drawing Sheets

MOTORIZED SCAFFOLD HOISTING APPARATUS

BACKGROUND OF THE INVENTION

The present invention relates generally to provision of scaffolds for construction purposes and more specifically to motorized scaffold hoisting apparatus for use in general construction work on buildings.

A scaffold is defined as a temporary or movable platform (e.g., a wooden or metal plank) that is supported from below by one or more suitable devices such as a stationary framework or jacks on poles, or suspended from above using rope and tackle or a roof-mounted hoist. Scaffolds are used for supporting workers and also materials of construction such as shingles, bricks, and painting materials. Most scaffolds used for working on two or three story buildings are supported by rope and tackle devices or by jacks on poles. Pole jacks are more convenient to use, but they are more costly. The prior art relating to pole jacks, and poles specially designed for use with pole jacks ("jack poles"), is exemplified by U.S. Pat. Nos. 4,382,488; 4,223,507; 5,042,615; 4,805,735; 4,598,794; 4,597,471; and 5,259,478.

There have been prior efforts to provide motor-powered scaffold hoists for construction work on two and three story buildings, but such efforts have achieved little or no success. Size, cost, adequate fail-safe operation and ease of installation and use are critical factors affecting commercial success.

SUMMARY OF THE INVENTION

The primary object of the invention is to provide new and improved scaffold hoisting mechanisms for use on buildings of limited height, e.g., 2- or 3-story buildings.

Still another object is to provide new and improved electrically-powered scaffold hoisting mechanisms.

A further object is to provide scaffold hoisting mechanisms that incorporate fail-safe brake mechanisms.

A more specific object is to provide novel scaffold-hoisting units that are designed to be slidably mounted on conventional jack poles and are adapted to be driven by conventional portable electric drivers.

Another specific object is to provide scaffold-hoisting apparatus that overcomes deficiencies and limitations of prior devices of like purposes.

A further specific object is to provide apparatus comprising a pole and a scaffold-hoisting device that is mounted on the pole.

These objects, and also other objects rendered obvious by the following description, are achieved by providing novel motorized scaffold hoisting units that are intended to be used in pairs. Each motorized scaffold hoisting unit comprises a carriage that is adapted to be slidably disposed on a jack pole, the carriage comprising a frame section and guide means that restrain the carriage from moving laterally while allowing it to be raised or lowered along the length of the pole. Each hoisting unit also comprises a hoist or winch that is mounted on a platform carried by the carriage and comprises a cable-carrying drum and a power transmission for rotating the drum in response to rotative power supplied by an auxiliary electrically powered driver. The cable carried by the drum has one end affixed to the drum and its opposite end connected to means for attaching it to the upper end of the jack pole on which the unit is mounted. Each carriage also carries at least two fail-safe brake means for releasably gripping the pole on which the carriage is mounted, and scaffold support means in the form of a laterally-projecting arm for supporting a scaffold, e.g., a wooden or aluminum plank. Each power transmission is adapted to be driven by a conventional electrically powered portable driver, e.g., a battery-powered electric drill fitted with a socket wrench that mates with the input shat of the power transmission. Other features and advantages of the invention are disclosed or rendered obvious by the following detailed description of a preferred embodiment and the accompanying drawings.

THE DRAWINGS

In FIGS. 1–5, like components are identified by like numerals.

DESCRIPTION OF THE PREFERRED EMBODIMENT

Figure 1:
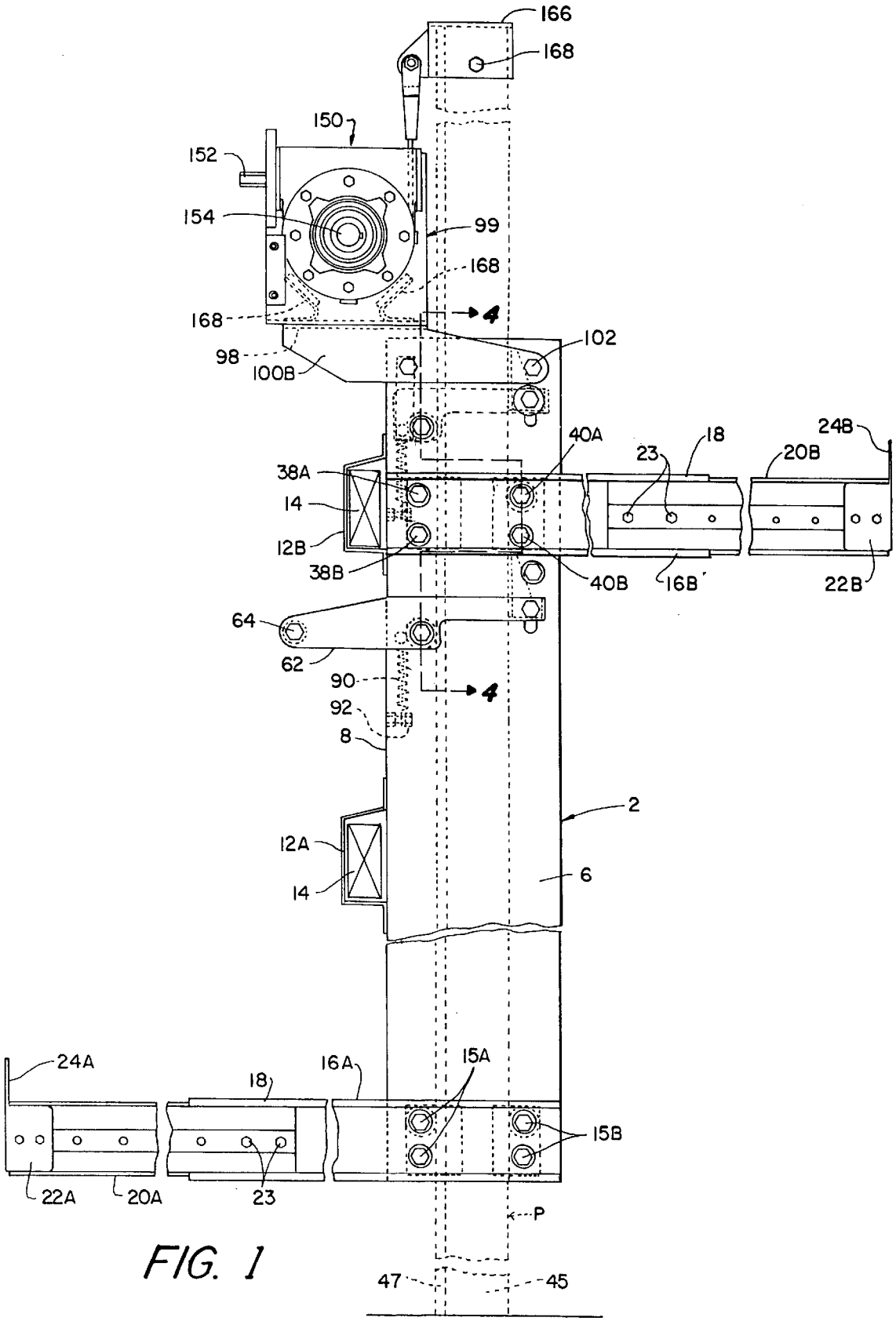
FIG. 1 is a side view in elevation of a scaffold-hoisting unit of the present invention in relation to a jack pole on which the unit is to be mounted, the jack pole being shown in phantom solely to better distinguish it from the hoisting unit.
Figure 2:
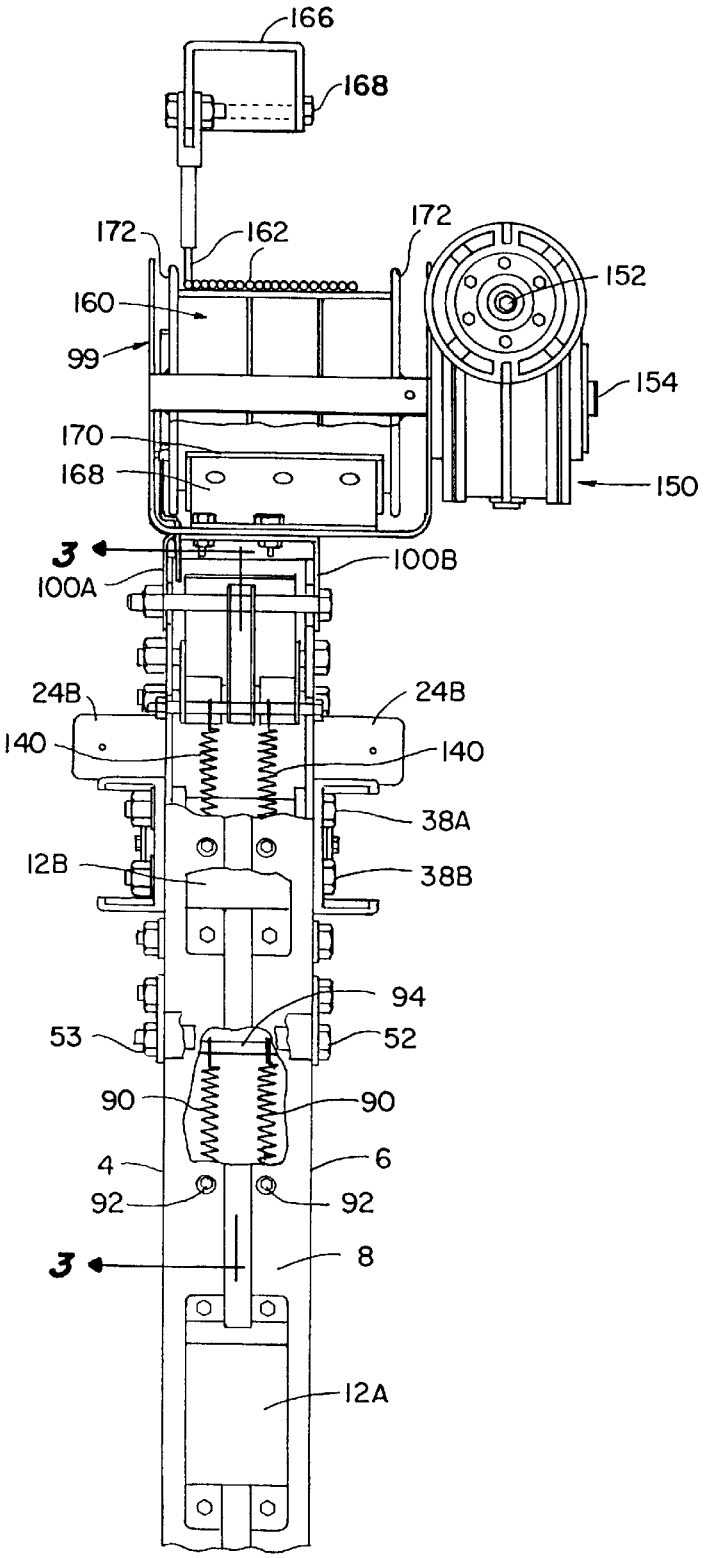
FIG. 2 is a fragmentary front view in elevation of the same hoisting unit.
Figure 3:
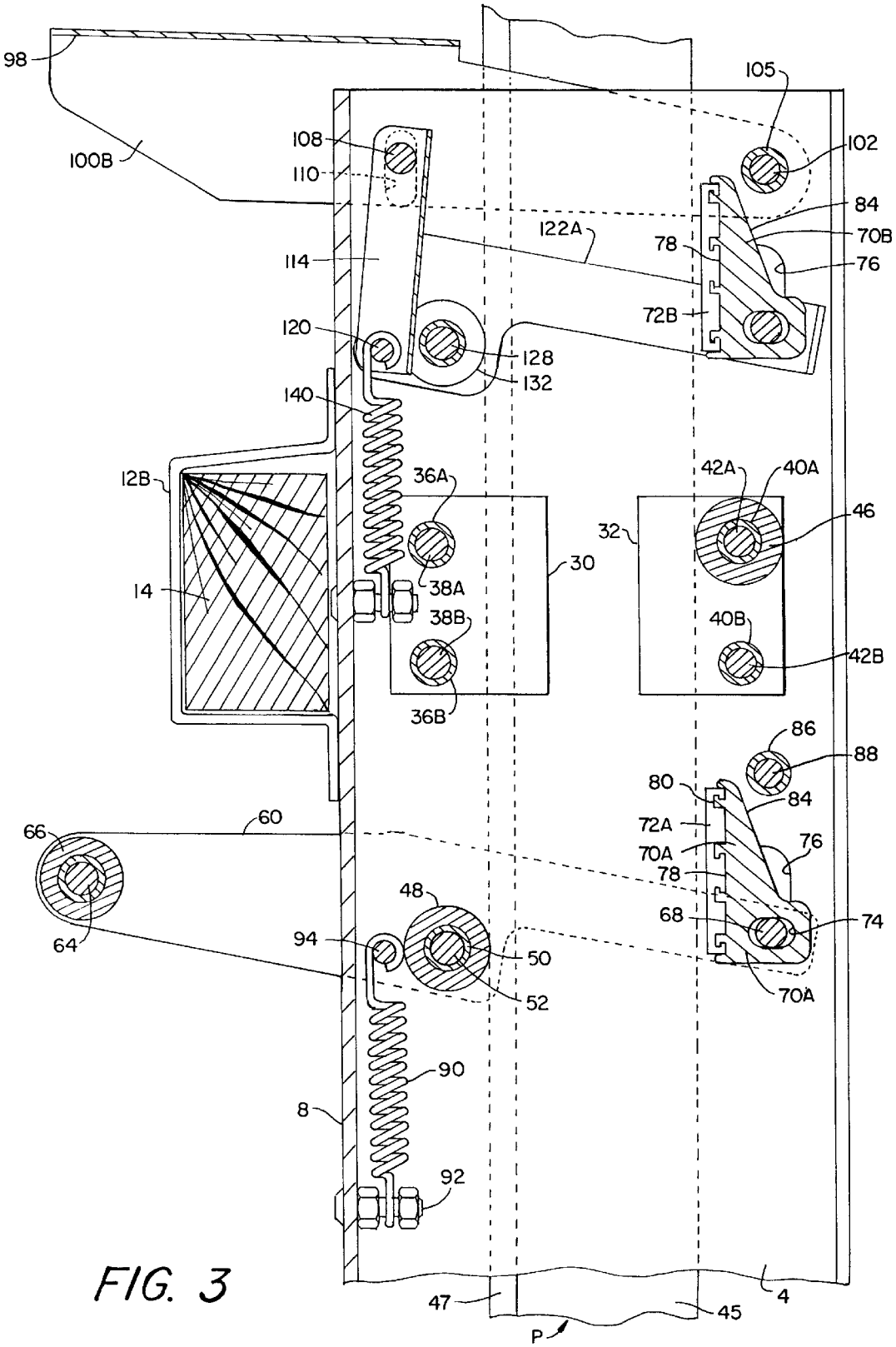
FIG. 3 is a sectional view in side elevation of the hoisting unit taken along line 3—3 of FIG. 2.

Referring to FIGS. 1–4, the preferred embodiment of the invention comprises a carriage 2 that is designed to make a relatively close sliding fit with a conventional jack pole of rectangular cross-section, e.g., an aluminum pole as shown by U.S. Pat. Nos. 4,223,507; 4,382,488; 4,432,435; 4,446,945; and 5,042,615; or a wooden 2"×4". Carriage 2 has a metal frame of U-shaped cross-section consisting of two parallel side walls 4 and 6 and a connecting front wall 8. Preferably but not necessarily the two side walls have internal right angle flanges 10 at their rear-ends (FIG. 3). Welded to front wall 8 at longitudinally spaced locations are two like channel members 12A, 12B (FIGS. 1, 2 and 3) that define channels for removably accepting workmen guard rails 14. The latter may be conventional wooden 2×4's or extruded aluminum members.

Also bolted to each of the frame side walls 4 and 6 by bolts 15A and 15B and nuts (not shown) are two cantilever workmen scaffold supports that comprise like metal channel members 16A (FIG. 1) that extend forwardly away from carriage 2. Each member 16A has L-shaped flanges 18 along each side edge so as to form guide channels for telescopically receiving complementary channel-like metal extension members 20A. Attached to the forward end of each extension member 20A is a metal bracket 22A having an upstanding leg 24A that functions as a stop. Extensions 20A serve as supports for one end of a plank (a portion of which is shown in phantom at 26) that functions as a platform or scaffold on which a workman can stand. Leg 24A acts as a stop or restraint to prevent the plank from slipping forward off of member extension 20A. The latter can be moved lengthwise relative to channel members 16A toward or away from carriage 2. However, channel members 20A are releasably locked in a selected position relative to channel members 16A by bolts and nuts as represented generally at 23.

A second like pair of cantilever scaffold supports comprising channel members 16B are mounted to side walls 4 and 6 of the frame of carriage 2 above the level of channel members 16A and 20A. Channel members 16B are attached to side walls 4 and 6 by bolts 38A, 38B and 40A, 40B described hereinafter. Channel members 16B extend rearwardly away from carriage 2. Each of the channel members 16B has L-shaped flanges 18B, and channel-like extension members 20B are telescopically coupled to channel members 16B. Channel members 16B and 20B are of like construction as members 16A and 20A respectively. Member 20B carries a bracket 22B identical to bracket 22A. Bracket 22B has an upstanding leg 24B like leg 24A. Channel members 20B are releasably locked to channel members 16B by bolts and nuts as represented generally at 23. This second pair of support arms 16A, 16B acts to support one end of a plank (not shown) that functions as a platform or scaffold for construction materials, e.g., bricks, shingles, etc.

Figure 4:
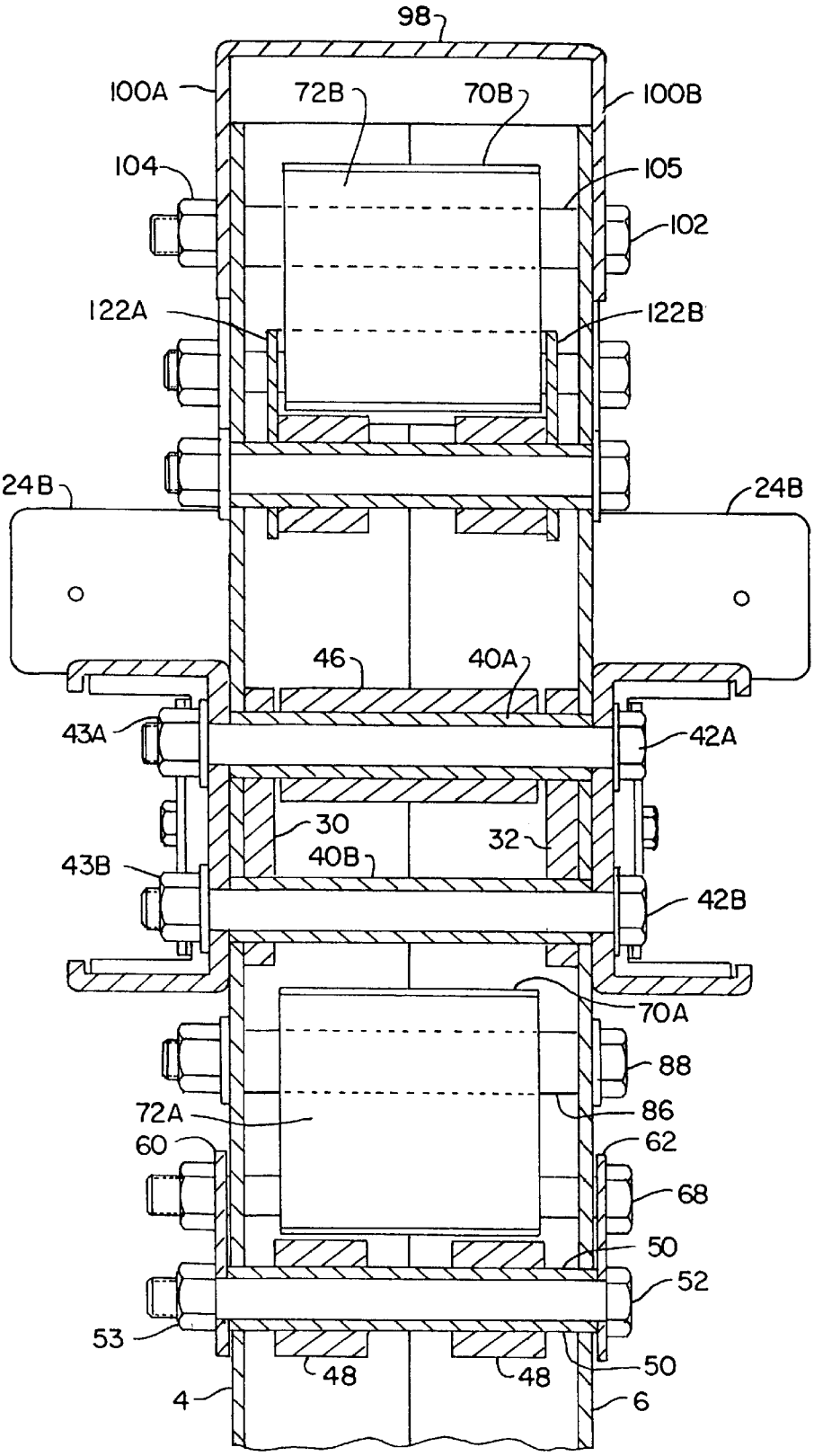
FIG. 4 is a sectional view taken along line 4—4 of FIG. 1.

Referring now to FIGS. 3 and 4, two pairs of slide pads 30 and 32 are attached to the inner surface of each of the side walls 4 and 6. Pads 32 are disposed rearward of pads 30. Pads 30 and 32 are made of a low friction material, preferably Teflon ®, and have a thickness such that their inner surfaces will be close to or lightly contact the opposite flat sides 45 (FIG. 1) of a conventional jack pole P of rectangular cross-section, e.g., an aluminum or wood pole as described above. Preferably pole P is constructed in the form of a hollow metal member 39 having a generally rectangular cross-section and a face member 47 that provides a flat face for engagement by confronting components of carriage 2, similar to the aluminum poles described in the patents mentioned hereinabove.

Each pad 30 has a pair of holes that are sized so as to accept cylindrical spacers 36A and 36B (FIG. 3) that are mounted on tie bolts 38A and 38B respectively that are used to secure the two channel members 16B to side walls 4 and 6. The latter walls have holes that are sized to accommodate spacers 36A, B. Channel members 16B have holes sized to accept bolts 38A, 38B but not spacers 36A, 36B. Instead the latter engage the inner surfaces of channel members 16B. Bolts 38A, B are secured in place by nuts. The engagement of the pads 30 with spacers 36A, 36B helps keep those pads in fixed relation to side walls 4 and 6.

Each pad 32 has a pair of holes that are sized to accept cylindrical spacers 40A, 40B that are mounted in a second set of tie bolts 42A, 42B that also serve to secure channel members 16B to side walls 4 and 6. Spacers 40A, 40B and bolts 42A, 42B extend through holes in side walls 4 and 6 (FIG. 4). Channel members 16B have two holes sized to accept bolts 42A, 42B but not spacers 40A, 40B. Nuts 43A, B (FIG. 4) secure bolts 42A, 42B in place. Spacers 40A also serve to rotatably support a stabilizer roller 46 (FIGS. 3, 4) that is sized so that it will engage the adjacent face of pole P. Roller 46 extends between but is spaced a short distance from the two pads 32 so as to be free to rotate on spacer 40A.

Two additional stabilizer rollers 48 (FIGS. 3, 4) are rotatably mounted on another spacer 50 that is mounted on another shaft in the form of a tie bolt 52 that extends through walls 4 and 6 and is secured in place by a nut 53. Bolt 52 also serves as a pivot shaft for a manual brake mechanism hereinafter described. Rollers 48, like rollers 46 and 132, are disposed to engage adjacent surfaces of pole P and thereby limit lateral motion of carriage 2 relative to pole P.

Referring now to FIGS. 1–4, the manual brake mechanism comprises a pair of brake arms in the form of a pair of thin parallel levers 60, 62 that are pivotally mounted on bolt 52. Levers 60, 62 extend outside of side walls 4 and 6 respectively. Spacer 50 (FIG. 3) lightly engages the inner surfaces of lever arms 60, 62 as shown in FIG. 4. The forward (front) ends of brake arms 60, 62 are coupled together by a handle assembly that comprises a tie rod 64 (FIGS. 1 and 3) and a cylindrical handle member 66 that rotatably surrounds the tie rod and extends between the inner surfaces of the two brake arms. The rear ends of brake arms 60, 62 are connected together by a tie rod 68 (FIG. 3) that acts as a pivot shaft for a first brake pad assembly that comprises a pad support 70A and a brake pad 72A. Pad support 70A has a hole 74 that is elongated laterally of its length to accommodate its pivot shaft 68, thereby permitting the pad support to undergo limited lateral motion relative to pivot shaft 68. Side walls 4 and 6 also have holes 76 that are elongated vertically (as viewed in FIG. 3) and also have a width (measured horizontally in FIG. 3) that is oversize relative to shaft 68. Hence, as seen in FIG. 3, brake arms 60, 62 can be rotated on shaft 52 through an arc limited by the size and shape of holes 76.

Pad support 70A is formed with a flat pad-engaging front surface 78 that is provided with ribs 80 that interlock with keyways in pad 72A. The keyways in pad 72A may be sized so as to permit removal and replacement of pad 72 by sliding the latter endwise. Pad support 70A also is formed with a flat back surface 84 that is inclined relative to front surface 78.

The manual brake assembly also includes a cam roller 86 that extends between side walls 4 an 6 and is mounted on a tie rod 88 that extends through and is secured to the side walls in the same manner as bolts 38, 40 and 52. Cam roller 86 is disposed so as to intercept the slanted surface 84 of the pad support when the brake arms 60, 62 are pivoted counterclockwise (as viewed in FIG. 3). When this occurs, cam roller 86 is engaged by pad support 70 and acts on the latter to cause the brake pad assembly to shift forward and also rotate clockwise on pivot shaft 68, thereby forcing brake pad 72 into tight engagement with pole P. It is to be noted that brake arms 60, 62 are urged counterclockwise (as viewed in FIG. 3) by a pair of tension springs 90 which are attached to two stub shafts 92 that are affixed to front wall 8. The other ends of springs 90 are attached to a tie rod 94 that extends between and is secured to brake arms 60, 62. Tie rod 94 extends through holes in side wall 4 and 6 that are oversized so as to allow movement of that tie rod relative to the side walls for the purpose of allowing pivotal movement of brake arms 60, 62. Springs 90 act to keep the brake pad assembly in contact with cam roller 86, so that normally brake pad 72 is engaged with pole P.

Referring now to FIGS. 1–5, the illustrated embodiment of the invention also comprises a hoist or winch support in the form of a platform 98 that has two depending legs 100A and 100B (FIG. 2) that extend down outside of side walls 4 and 6. Legs 100A and 100B are pivotally secured to side walls 4 and 6 by a pivot shaft in the form of a bolt 102 that is secured in place by a nut 104, whereby the platform can pivot relative to carriage 2. Surrounding shaft 102 is a cam roller 105. Extending between and attached to legs 100A, 100B is a travel limit shaft 108 that also extends through two vertically elongated holes 110 (FIGS. 3 and 5) in side walls 4 and 6 of the carriage frame. Secured to travel limit shaft 108 are two connecting levers 114. The bottom ends of levers 114 are pivotally mounted on a pivot shaft 120 that extends between and is carried by forward end portions of two upper brake arms 122A, 122B (FIGS. 1 and 3) that form part of a second fail-safe brake mechanism. The latter are pivotally mounted on a pivot shaft 128 that is mounted to and extends between side walls 4 and 6. A stabilizer roller 132 is rotatably mounted on shaft 128. Roller 132 is sized and positioned so as to engage pole P. The rear ends of upper brake arms 122A, 122B are connected by an upper brake pivot shaft 68B. Rotatably mounted on pivot shaft 68B is a second brake pad assembly that comprises a pad support 70A and a brake pad 72A that are like pad support 70B and brake pad 72. Pad support 70B has an elongated hole 74 to allow lateral movement thereof relative to pivot shaft 136. Side walls 4 and 6 have like holes 76 to permit movement of shaft 68B as brake arms 122A, 122B are pivoted on shaft 128. A pair of tension springs 140 are anchored at one end to a bolt 142 anchored to front wall 8 of the frame 2, while their other ends are attached to rod 120. Springs 140 act to urge brake arms to rotate counterclockwise (as seen in FIG. 3). Cam roller 105 functions like cam roller 86, camming pad support 70B in a direction to force pad 72B into engagement with pole P when arms 120A, 122B are moved counterclockwise as viewed in FIG. 3.

Figure 5:
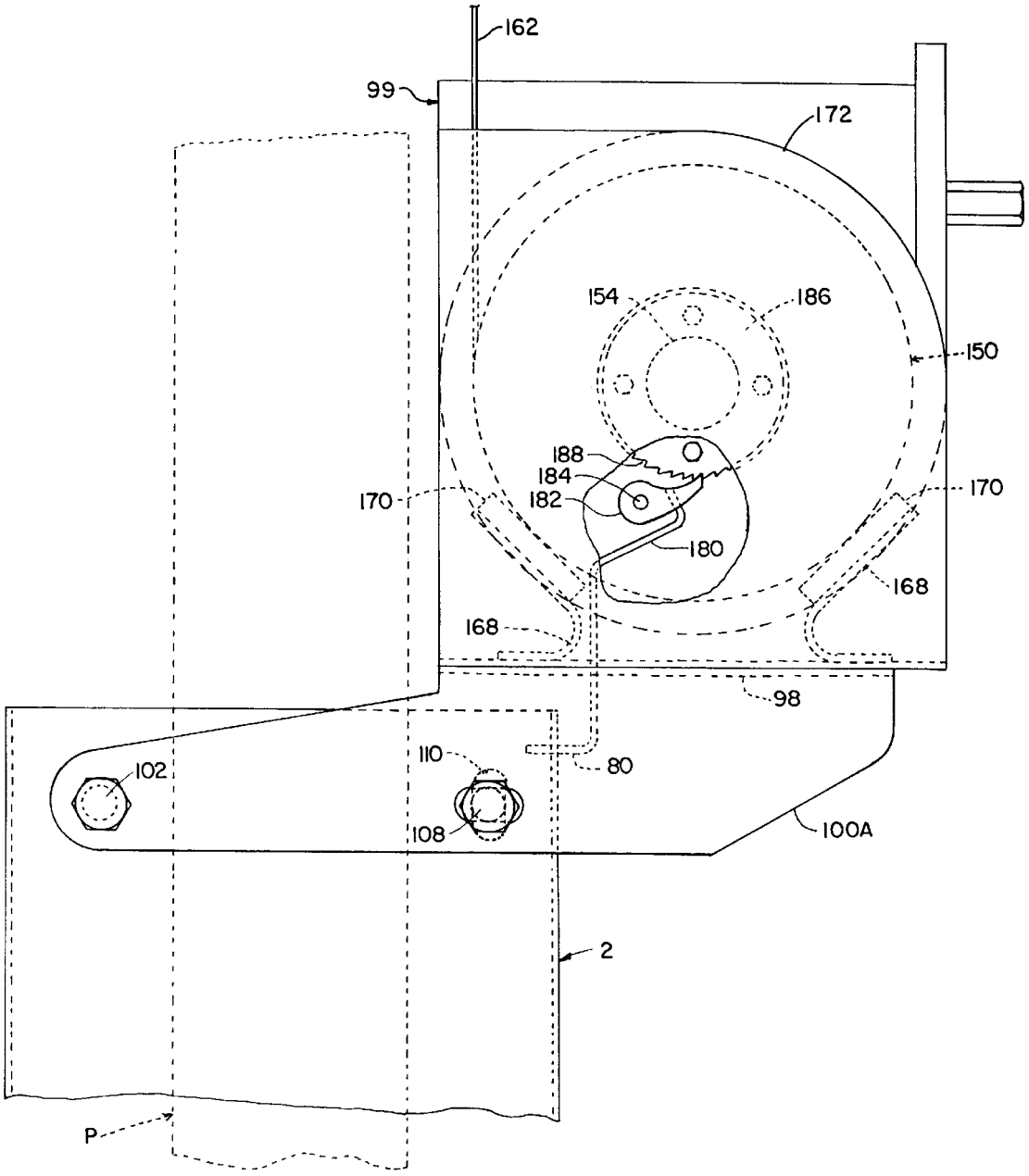
FIG. 5 is a fragmentary side elevation on an enlarged scale of the power transmission and its supporting platform, with a portion of a member broken away to show details of a pawl-type transmission lock.

Mounted on and secured to platform 98 is a U-shaped hoist or winch support 99 (FIGS. 1, 2 and 5). A power transmission unit in the form of a gear reducer identified generally by the numeral 150 is attached to support 99. The gear reducer 150 has an input shaft 152 and an output shaft 154. Input shaft 152 is adapted to be connected to the shaft of a separate driver device (not shown). According to the preferred form of this invention, the driver is a separate unit that preferably takes the form of a battery-powered electrical drill or electrical rotating driver (not shown) with a driving tool (not shown) attached to its output shaft that is adapted to mate with input shaft 152. By way of example, shaft 152 may have a hexagonal outer configuration and the driving tool carried by the driver may be in the form of a socket wrench sized and shaped to make a locking connection to shaft 152. Alternatively, shaft 152 may have a hexagonal cavity in its outer end and the driver tool carried by the driver may have a male end sized and shaped to fit in the cavity so as to make a locking engagement with shaft 152.

Referring now to FIGS. 1, 2 and 5, gear reducer output shaft 154 is coaxial with and connected to the shaft 159 of a drum 160. Shaft 159 of drum 160 is rotatably mounted in opposite side walls of U-shaped support 99 (FIG. 2). A flexible metal cable 162 is mounted on drum 160, with one end of the cable being attached to the drum and the other end being secured to a cap member 166 that is adapted to fit on the upper end of a jack pole P. If desired, pole P may have a hole to receive a lock bolt 168 which also extends through opposite walls of cap member 166 and has a nut on its free end, all for the purpose of releasably locking cap member 166 to the jack pole.

Turning now to FIGS. 1, 2 and 5, two cable guides are carried by U-shaped support 99. The cable guides comprise brackets 168 attached to support 99 and pads 170 that are attached to brackets 168 and extend between the two flanges 172 of drum 160. Pads 170 are spaced from drum 160 by a distance that is only slightly greater than the diameter of cable 160 so as to assure that the cable will wrap around the drum in a single layer of turns.

Additionally, the illustrated invention includes a safety lock for the drum and gear reducer. As seen in FIG. 5, the safety lock comprises an angulated link or bracket 180 (FIG. 5) attached to the upper end of carriage 2, and a pawl 182 that is pivotally attached at 184 by the upper end of link 180. Attached to one end of drum 160 is a ratchet gear 186 having a plurality of saw-tooth shaped teeth 188 that are engaged by pawl 182. When engaged, pawl 182 and teeth 188 cooperate to (a) allow the drum to rotate in a direction to permit the drum to rotate so as to cause the cable to wind thereon (counterclockwise as seen in FIG. 3), and (b) prevent the drum from rotating in the opposite direction. However, since link 180 is attached to carriage 2 and platform 99 can pivot relative to carriage 2 on pivot shaft 102, the locking action of pawl 182 on the drum can be disrupted by pivoting the platform 98 clockwise from the position shown in FIG. 5.

MODE OF OPERATION

In practice, erection of a scaffold involves use of two jack poles P and two scaffold-hoisting units made according to this invention, with the carriage of each hoisting unit being mounted on a separate pole in an arrangement (not shown) similar to how two pump jacks are used with two vertical poles for scaffold-supporting purposes (e.g., see prior art patents cited above for pump jack scaffold-supporting arrangements). The free end of the cable 162 of each unit is attached to the top end of the pole P on which the unit is mounted. Then the two poles are erected next to a building wall and an operator-supporting scaffold in the form of at least one plank 26 is positioned so that it extends between and is supported by the laterally-projecting arms 20A of the two units. In this initial setup position, the two hoisting units are located close to the bottom ends of the two poles next to the ground. It should be noted that the pull of gravity will urge the hoisting units in a downward direction, so that the manually operated brake of each hoisting unit is automatically engaged with the poles in a fail-safe mode as a consequence of the action of the associated spring 90, whereby the manually operated brakes operate to prevent the carriages 2 from moving downward. Additionally, unless the cables 162 are under tension, gravity and the pull of springs 140 cause the second brake pads 72B to be automatically engaged with the supporting jack poles Assuming now that two workmen place themselves on their supporting scaffold (plank 26) carried by the two hoisting units, and further that the two workmen wish to raise their supporting scaffold, they may accomplish this movement by engaging the input shaft 152 of each of the two hoisting units with a suitable tool mounted on the drive shaft of an electrically-powered driver, and then simultaneously activating the two drivers so as to apply rotative power to the power transmissions 150 of the two hoisting units, whereby to cause the two drums to rotate in the direction required to wind the cables on the drums, thereby causing the carriages and hence the workmen supporting scaffold to move up on the two poles. Applying rotative power to the two hoisting units so as to cause those units and the scaffold which they support to move up the two jack poles can be accomplished without manually disengaging the manually operated brake unit, since, unless it is released, that brake (like the brake unit operatively connected to hoist support 98) is designed to impede only downward movement of the hoisting units on the poles.

The two brake units do not lock the hoisting units against upward movement on the poles. In the case of the manually operated brake, on upward movement of the hoisting unit the friction between the brake pads 72A and the poles tends to cause the brake pad supports 70A to move down away from cam rollers 86, thereby effectively freeing those brake pads from the jack poles so as to permit upward movement of the carriages on the poles. On the other hand, unless the manually operated brakes of the two hoisting units are released manually, or unless the hoisting units are urged upwardly by a force exerted through cable 162, the springs 90 of the manually operated brakes and the camming action of cam rollers 86 on the brake pad supports 70 will cause brake pads 72 to be engaged with the two poles, thereby effectively preventing downward movement of the hoisting units on the vertical jack poles.

The second hoist-support coupled brake of each hoisting unit provides a second fail-safe function, since it disengages only when the hoisting cable is under tension and automatically re-engages when tension in the cable is released. In this connection it should be noted that if there is no tension on cable 162, spring 140 will pull hoist-support platform 98 down to the position shown in FIG. 1, in which position brake support member 70B will be engaged with cam roller 104. thereby causing brake support member to pivot so as to bring brake pad 72B into engagement with pole P. As a result, brake pad 72B will lock the carriage against downward movement relative to pole P. However, if drum 160 is urged by the transmission in a direction to wind cable on the drum (whereby to raise the hoisting unit), the tension on the cable will urge platform 98 to pivot in opposition to the force exerted by spring 140. At a certain tension level, the tension on the cable will be enough to overcome the force of spring 140, with the result that the supporting platform 98 is pulled upward (pivoting clockwise as seen in FIG. 3) far enough to cause levers 114 to disengage brake pad support 70B from cam roller 105. When operation of the power transmission in a cable winding direction is deliberately terminated, there tends to be a relaxation of tension on the cable. The extent of the relaxation of cable tension may be sufficient to cause spring 140 to force the upper brake to re-engage pole P, in which cause the hoisting unit is held in place by operation of two brakes. However, if the tension on the cables when the transmissions are stopped is not sufficient to allow re-engagement of the two upper brake mechanisms, the operators may initiate reverse motion of the two transmissions just enough to release the tension on the cables to the extent necessary to re-engage the two upper brake mechanisms.

In the event that it is desired to lower the scaffold, the two operators may accomplish this result by (1) manually disengaging the lower manually-operated brake mechanisms and (2) while those brakes are disengaged, applying power to the two transmissions in a direction to cause them to rotate the drums in a cable-unwinding direction, whereupon the two hoisting units will move down. When the scaffold has been lowered to a desired level, the downward motion of the two hoisting units may be terminated in two ways. The first way is by first terminating operation of the two transmissions and releasing the manually-operated brakes. However, since the cables are still under tension, the upper brake units will still be disengaged from the two jack poles, with the result that the two hoisting units are held in their current elevated position by the now stationary cables. This is not a safe condition, and so it is necessary to reengage the two lower manually operated brake units. This is achieved by releasing the handles 66 of the manual brake units, thereby causing their brake pads 72 to re-engage the two poles. At this point the two hoisting units are now locked against further descent by the engagement of pole P by the two manually operable brakes.

The second way is by first releasing the handles 66 of the manual brake units, thereby causing their brake pads to re-engage the two poles and stopping further downward motion of the two hoisting units. Thereafter, operation of the two transmissions is continued for only a short time sufficient to release the tension on the two cables, in which event the springs 140 cause the two upper brake mechanism to re-engage the two poles P. As a result, two brakes lock each hoisting unit against further descent.

The primary advantage of the upper brake mechanism is that is a fail-safe mechanism. In the event that one or both of the cables should break while the lower brakes are disengaged, the loss of tension in the cable(s) will allow the spring(s) 140 to automatically cause re-engagement of the upper brake mechanism(s), thereby preventing downward movement of the hoisting unit(s).

The transmission lock mechanism constitutes a backup safety measure. In most cases it may be omitted since the inherent nature of a gear reducer is that it is difficult to operate the gear reducer in a backward direction. In essence, the gear reducer acts as a brake when urged in a reverse drive direction. Hence the gear reducer acts to oppose unwinding of the cable on the drum when no input torque is applied to the input shaft of the gear reducer.

Of course the invention may be modified in various ways obvious to persons skilled in the art. Thus, different forms of brake mechanisms may be used. Also the pawl-type lock mechanism may be omitted. A further possible modification is to physically attach reversible electrical motors to the transmissions in place of using separate portable reversible drivers, with those motors being connected by appropriate electrical conductors to a suitable remote power source so as to enable the transmissions to be driven by the motors. Also, it should be appreciated that the term "jack pole" is used merely as a matter of convenience since that term has a certain meaning in the art. Moreover the term "jack pole" is to be deemed to be merely illustrative of various forms of poles that may be used in practicing the present invention, since the form of the supporting pole may be varied in ways obvious to persons skilled in the art. Still other changes will be obvious to persons skilled in the art.

The invention has various advantages. In addition to those advantages mentioned in or rendered obvious by the foregoing description, it should be noted that the hoisting units may be used with various forms of poles. Also the hoisting units are adapted to carry scaffolds not only for supporting workmen but also for supporting constructions materials or tools that are to be used by the workmen. A further advantage is that the transmissions are adapted to be operated by separate portable reversible drivers, and also that the drivers may be electrically powered or pneumatically powered, although electrically-powered drivers are preferred. Also although battery-powered electrical drivers are preferred, the drivers may be of the type that need to be coupled directly to a conventional electrical outlet. Still other advantages will be obvious to persons skilled in the art from the foregoing specification and the accompanying drawings.

What is claimed is:

1. A scaffolding hoisting apparatus comprising:

a frame adapted to slidingly embrace a pole having a lower end and an upper end, said frame comprising first and second side walls;

scaffold support means attached to and carried by said frame;

a hoist support pivotally mounted to said frame;

a first brake unit carried by said frame, said first brake unit comprising a brake pad assembly disposed between said first and second side walls and movable into and out of frictional engagement with said pole, means normally biasing said brake pad assembly for frictional contact with said pole, and manually operable means for moving said brake pad assembly out of engagement with said pole;

a second brake unit associated with said hoist support having means for making frictional contact with said pole; and a hoist carried by said hoist support, said hoist comprising a rotatable drum, a cable having first and second ends with said first end attached to said drum and said second end adapted to be secured to said upper end of said pole, and a power transmission means having an output shaft connected to said drum and an input shaft that is coupled to said output shaft and is adapted to be connected to a source of rotative power, whereby application of rotative power to said input shaft will cause said output shaft and thereby said drum to rotate in response to rotation of said input shaft, so as to cause said cable to wind on or unwind from said drum.

2. A scaffolding hoisting apparatus according to claim 1 wherein said second end of said cable comprises means for securing said second end to said upper end of said pole.

3. A scaffolding hoisting apparatus according to claim 2 wherein said securing means comprises a cap member adapted to fit over the upper end of said pole.

4. A scaffolding hoisting apparatus according to claim 1 wherein said power transmission means comprises a gear reduction unit mounted to said hoist support characterized in that multiple revolutions of said input shaft are required to accomplish a single revolution of said output shaft.

5. A scaffolding hoisting apparatus according to claim 1 wherein said second brake unit comprises a brake pad assembly movable into and out of frictional engagement with said pole in response to pivotal movement of said hoist support.

6. A scaffold hoisting apparatus according to claim 5 wherein said brake pad assembly of said second brake unit is moveable into frictional engagement with said pole when said hoist support is pivoted in a first direction, and further including means for urging said hoist support to pivot in said first direction.

7. A scaffolding hoisting apparatus according to claim 1 wherein said power transmission means comprises a gear reduction unit having an output shaft coupled to said drum and an input shaft that is adapted to be driven by an exterior power driver.

8. A scaffold hoisting apparatus according to claim 1 comprising two mutually-spaced scaffold support means attached to said frame, one for supporting a scaffold for a human operator and the other for supporting a scaffold for work materials to be used by the human operator.

9. A scaffold hoisting apparatus according to claim 4 further including an electric motor mounted to said hoist support and mechanically coupled to said gear reduction unit, whereby said gear reduction unit is driven by said motor when said motor is energized.

10. A scaffolding apparatus comprising:

first and second elongate poles each having an upper end and a lower end; and first and second scaffold hoisting units each slidably mounted on a different one of said first and second poles;

each of said hoisting units comprising:

(A) a frame slidably embracing one of said poles, said frame having first and second opposite side walls;

(B) scaffold-support means carried by said frame;

(C) first and second mutually spaced brake means carried by said frame, each of said brake means comprising a pair of levers pivotally mounted to said frame in parallel relation to said side walls, a support shaft extending between and connecting said levers, a brake pad assembly mounted on said support shaft and movable by pivotal movement of said levers into and out of frictional engagement with said one pole, and spring means biasing said levers to pivot in a direction to move said brake pad assembly into engagement with said one pole;

(D) a hoist support carried by said frame; and (E) a hoist carried by said hoist support, said hoist comprising a drum rotatably mounted to said hoist support, a cable having first and second ends with said first end attached to said drum and said second end adapted to be secured to said upper end of said one pole, and a power transmission means mounted to said hoist support for rotating said drum, said power transmission means comprising a gear reduction unit having an output shaft connected to said drum and an input shaft adapted to be connected to a source of rotative power, whereby operation of said power transmission means in a first direction will cause said drum to rotate in a direction to wind said cable on said drum and thereby raise said frame along said one pole and operation of said power transmission means in a second opposite direction will cause said drum to rotate in a direction to unwind said cable from said drum and thereby lower said frame along said one pole, whereby operation of said power transmission means of said first and second hoisting units in said first direction will cause said first and second scaffold hoisting units to be raised relative to said first and second poles respectively and operation of said power transmission means of said first and second hoisting units in said second opposite direction will cause said first and second scaffold hoisting units to be lowered relative to said first and second poles respectively.

11. A scaffolding apparatus according to claim 10 wherein said second end of said cable is attached to a cap member that extends over and is attached to the upper end of said one pole.

12. A scaffolding apparatus according to claim 10 wherein said brake pad assembly comprises a pad support and a brake pad attached to said pad support, said pad support having a hole therein and said support shaft extending through said hole so as to support said brake pad assembly, said hole being shaped so as to permit said brake pad assembly to pivot on said support shaft and to move laterally relative to that support shaft a limited distance, and further including a cam disposed to intercept said brake pad assembly and cause it to pivot and shift laterally relative to said support shaft toward said pole as said levers are pivoted to move said brake pad assembly into frictional engagement with said pole.

13. A scaffold hoisting apparatus for use with a jack pole, said apparatus comprising:

a frame adapted to slidingly embrace a pole that has first and second opposite ends;

brake means carried by said frame, said brake means comprising first and second brake units each comprising a brake pad assembly movable into and out of frictional engagement with said pole, and spring means for normally biasing said brake pad assembly for friction engagement with said pole, whereby to prevent movement of said frame in a first direction only relative to said pole;

a hoist support pivotally mounted to and carried by said frame;

a hoist carried by said hoist support, said hoist comprising a drum, means rotatably mounting said drum to said hoist support, power transmission means mounted to said hoist support, said power transmission means comprising a gear reduction unit having an output shaft and an input shaft, with said output shaft coupled to said drum so that said drum will rotate with said output shaft and said input shaft adapted to be connected to a source of rotative power, and a cable having first and second ends with said first end attached to said drum and said second end having means for securing said second end to one of said first and second ends of said pole; and means connecting said hoist support and said second brake unit for moving the brake pad assembly of said second brake unit into or out engagement with said pole according to the direction of pivotal movement of said hoist support relative to said frame; and said first brake unit being manually operable.

14. A scaffold hoisting apparatus according to claim 13 further comprising means attached to one side of said frame for supporting a platform for a human operator, and means attached to an opposite side of said frame for supporting a platform for a materials to be used by said human operator.

15. A scaffolding hoisting apparatus according to claim 13 wherein said input shaft is adapted to be driven by an exterior power driver.

16. A scaffold hoisting apparatus for use with a jack pole, said apparatus comprising:

a frame adapted to slidingly embrace a pole that has first and second opposite ends, said frame having first and second side walls;

brake means carried by said frame, said brake means comprising a pair of levers in side-by-side relationship with one another, means supported by said first and second side walls for pivotally supporting said levers, a brake member extending between and carried by said levers and disposed to confront a pole on which said frame is slidably mounted, said brake member being movable by pivoting movement of said levers from a first non-braking position to a second braking position to make frictional engagement with said pole, whereby to prevent movement of said frame in a first direction only relative to said pole, and spring means connected between said frame and said levers urging said levers to said second braking position;

a hoist support pivotally carried by said frame; and a hoist carried by said hoist support, said hoist comprising a drum, means rotatably mounting said drum to said hoist support, power transmission means mounted to said hoist support, said power transmission means comprising a gear reduction unit having an output shaft and an input shaft, with said output shaft coupled to said drum so that said drum will rotate with said output shaft and said input shaft adapted to be connected to a source of rotative power, and a cable having first and second ends with said first end attached to said drum and said second end having means for securing said second end to one of said first and second ends of said pole.

17. A scaffold hoisting apparatus according to claim 16, comprising a second brake means adapted to make frictional engagement with said pole, said second brake comprising a second pair of levers in side-by-side relationship with one another, means supported by said first and second side walls for pivotally supporting said second levers, a second brake member extending between and carried by said second levers and disposed to confront a pole on which said frame is slidably mounted, said second brake member being movable by pivoting movement of said second levers from a first non-braking position to a second braking position to make frictional engagement with said pole, whereby to prevent movement of said frame in a first direction only relative to said pole, and spring means connected between said frame and said second levers urging said second levers to said second braking position.

18. A scaffolding hoisting apparatus according to claim 17 wherein said first brake means is manually operable, and means connected between said levers of said second brake means and said hoist support for operating said second brake means in response to pivotal movement of said hoist support.

19. A scaffolding hoisting apparatus comprising:

a frame adapted to slidingly embrace a pole having a lower end and an upper end;

scaffold support means attached to and carried by said frame;

brake means carried by said frame having a brake member disposed to make frictional engagement with said pole, whereby to hold said frame against movement in one direction lengthwise of said pole;

a hoist support pivotally mounted to said frame;

a hoist carried by said hoist support, said hoist comprising a rotatable drum, a cable having first and second ends with said first cable end attached to said drum and said second cable end having mechanical means for securing said second end to said upper end of said pole, and a power transmission means having an output shaft connected to said drum and an input shaft that is coupled to said output shaft and is adapted to be connected to a source of rotative power, whereby application of rotative power to said input shaft will cause said output shaft and thereby said drum to rotate in response to rotation of said input shaft, so as to cause said cable to wind on or unwind from said drum; and a brake unit pivotally mounted to said frame, said brake unit including a brake pad assembly, and means coupling said brake unit to said hoist support so as to cause said brake unit to pivot so as to (a) move said brake pad assembly out of frictional engagement with said pole when said hoist support pivots in a first direction under the influence of tension on said cable and (b) move said brake pad assembly into frictional engagement with said pole when said hoist supports pivots in a second opposite direction when the tension on said cable is reduced.

20. A scaffolding hoisting apparatus according to claim 19 further including spring means normally biasing said brake unit in a direction to place said brake pad assembly in frictional engagement with said pole.

21. A scaffolding hoisting apparatus according to claim 19 wherein said power transmission means comprises a gear reduction unit characterized in that multiple revolutions of said input shaft are required to accomplish a single revolution of said output shaft.

22. A scaffolding hoisting apparatus according to claim 19 further including a second brake unit pivotally mounted to said frame and having a second brake pad assembly that is adapted to make frictional engagement with said pole, said second brake unit being spaced from said hoist support and being operable independently of said first-mentioned brake unit.

23. A scaffolding hoisting apparatus according to claim 22 wherein said second brake unit is mounted to a manually operable lever mechanism that is pivotally mounted to said frame.

24. A scaffolding hoisting apparatus according to claim 22 wherein said frame comprises first and second parallel side walls spaced from one another by an amount sufficient to accommodate a pole therebetween, and further wherein said first-mentioned brake unit and said second brake units each comprises a pair of levers that extend parallel to said side walls, with each brake unit having its said brake pad assembly disposed between and carried by its said levers, means pivotally mounting said levers to said frame, and means limiting pivotal movement of said levers.

25. A scaffolding hoisting apparatus according to claim 24 wherein said brake pad assemblies are pivotally mounted to said levers so that said brake pad assemblies can swivel, and cam means in position to be engaged by said brake pad assemblies and to cause said brake pad assemblies to swivel toward said pole as said levers are pivoted to move said brake pad assemblies into frictional engagement with said pole.

26. A scaffolding hoisting apparatus according to claim 19 further including a safety lock for releasably locking said drum against rotation in a cable-unwinding mode, said safety lock comprising a gear coupled to and rotatable with said drum, said gear having a plurality of saw-tooth shaped teeth, a locking pawl, and means mounted to said frame and pivotally supporting said pawl for engagement with said teeth, said pawl and teeth cooperating by their mutual engagement to allow said gear and drum to rotate in a direction to wind said cable on said drum and prevent said gear and drum from rotating in a direction to unwind cable from said drum, said pawl being disengageable from said gear when said hoist support pivots in a first direction and re-engageable with said gear when said hoist support pivots in a second opposite direction.

* * * * *

UNITED STATES PATENT AND TRADEMARK OFFICE

CERTIFICATE OF CORRECTION

PATENT NO. : 5,909,783

DATED : 06/08/99

INVENTOR(S) : Robert P. Berish

It is certified that error appears in the above-indentified patent and that said Letters Patent is hereby corrected as shown below:

Claim 14, column 11, line 20, delete the word "a".

Claim 19, column 12, line 44, change "supports" to -- support --.

Signed and Sealed this

Nineteenth Day of October, 1999

*Attest:*

Q. TODD DICKINSON

*Attesting Officer*

*Acting Commissioner of Patents and Trademarks*